United States Patent [19]

Nowak et al.

[11] 4,165,865

[45] Aug. 28, 1979

[54] CRUCIBLE MELTING FURNACE

[75] Inventors: Leonard G. Nowak, Ypsilanti, Mich.; Maurice Nunes, Arlington, Mass.; Paul K. Shefsiek, Farmington, Mich.

[73] Assignee: Holcroft and Company, Livonia, Mich.

[21] Appl. No.: 882,512

[22] Filed: Mar. 1, 1978

[30] Foreign Application Priority Data

Dec. 29, 1977 [JP] Japan ..... 52-158705

[51] Int. Cl.[2] ..... F27B 14/02; F27B 14/14

[52] U.S. Cl. ..... 266/138; 266/240; 266/242

[58] Field of Search ..... 266/138, 240, 242; 432/156, 157, 158, 262

[56] References Cited

U.S. PATENT DOCUMENTS

| | | | |
|---|---|---|---|
| 444,658 | 1/1891 | Barker | 266/242 X |
| 918,150 | 4/1909 | Hewitt | 432/157 |
| 1,241,397 | 9/1917 | Keith | 266/242 X |
| 1,545,008 | 7/1925 | O'Brien | 266/242 X |
| 1,547,872 | 7/1925 | Hawke | 432/158 |
| 1,695,467 | 12/1928 | Peterson | 432/156 |
| 1,866,795 | 7/1932 | Boyd | 266/242 X |
| 1,873,801 | 8/1932 | White | 266/242 X |
| 1,930,323 | 10/1933 | South et al. | 266/242 X |
| 2,180,774 | 11/1939 | Stanworth et al. | 432/156 |
| 2,252,319 | 8/1941 | Holden | 432/156 |
| 2,284,014 | 5/1942 | Peck | 266/264 X |
| 2,296,440 | 9/1942 | Heller | 432/156 |
| 3,458,179 | 7/1969 | O'Rourke | 432/157 |
| 3,459,414 | 8/1969 | Schmidt | 266/252 X |
| 3,667,745 | 6/1972 | Lazaridis | 266/242 |

FOREIGN PATENT DOCUMENTS

| | | | |
|---|---|---|---|
| 459620 | 9/1949 | Canada | 432/158 |
| 941314 | 4/1956 | Fed. Rep. of Germany | 266/242 |
| 413777 | 7/1934 | United Kingdom | 432/158 |
| 511572 | 8/1939 | United Kingdom | 432/157 |

*Primary Examiner*—Gerald A. Dost

*Attorney, Agent, or Firm*—James L. Neal; Herbert E. Messenger

[57] ABSTRACT

A crucible furnace for high-temperature melting of metals or other materials which includes a capped vessel for serving as a crucible to hold a charge of material to be melted, a solid baffle surrounding and closely spaced from the vessel to form a restricted passageway and a refractory wall surrounding and widely spaced from the baffle to form a combustion chamber. Fuel is supplied at the base of the combustion chamber and mixed with air preheated by a compact internal recuperator operative from exhaust gases exiting the restricted passageway. The fuel is burned in the combustion chamber, heating the baffle which in turn radiates heat to the vessel containing the charge. Several of the elements forming the combustion and heat transfer system also serve as structural elements providing rigid support to internal components when the furnace is upright and when it is tilted to pour off melt. Adjacent its top, openings are formed through the baffle to permit flame and combustion products to pass from the combustion chamber downwardly through the restricted passageway and recuperator region to the exhaust flue. Thus, heating of the vessel is also had by convection. The combustion chamber is isolated from the charge in the vessel by a seal, the integrity of which is maintained by downward pressure from a lip formed on the crucible.

5 Claims, 3 Drawing Figures

CRUCIBLE MELTING FURNACE

BACKGROUND OF THE INVENTION

High-temperature melting of materials, especially non-ferrous metals, is frequently carried out in either induction furnaces or in gas-fired furnaces in which the gas is burned in combustors arrayed about the crucible containing the charge. Insofar as induction furnaces are concerned, not only are original installations with special power supplies and related wiring very costly, electrical operating energy is also intolerably high.

On the other hand, conventional gas-fired furnaces are often so constructed that contamination by the combustion products of the charge being melted in the crucible is encountered. In fact, to achieve more efficient heating, it is sometimes the practice to literally circulate the products of combustion over the open crucible or vessel containing the charge. With such designs, in addition to contamination problems, there may be a significant loss of volatile elements from the charge. Such losses are not only objectionable because of the obvious loss of material but also because in the case of alloys, the proportions of the alloy constituents are changed. Finally, the entrainment of vaporized elements from the charge in the exhaust gases of the furnace contributes significantly to air pollution.

There are other problems associated with the operation of conventional crucible furnaces, such as high noise level, health hazards to operating personnel, and the need of cooling towers and special ventilating systems in the structures in which the furnaces are mounted.

SUMMARY OF THE INVENTION

The present invention is concerned chiefly with gas-fired crucible furnaces which are superior in numerous respects to induction furnaces and conventional gas-fired furnaces. In addition to eliminating or minimizing the problems outlined above, gas-fired crucible furnaces built in accordance with the present invention not only are more efficient in gas consumption but also may be installed at substantially lower costs than conventional furnaces of either the induction or gas-fired type. These advantages stem, at least in part, from a design in which components of the combustion system serve also as structural members in supporting the furnace both in its upright operating attitude and when it is tilted to pour off melt. Also, more efficient heat transfer and a positive sealing system between the combustion chamber and the crucible are features of the present invention.

In the preferred embodiment, exhaust heat is recuperated to preheat the incoming air which then passes out of a plenum through a swirler which imparts a helical motion to the air. A gas or a gas-air pre-mix intersects the combustion air at right angles, rapid and quiet mixing thus occurring as the fuel passes into a combustion chamber. The chamber is defined by an outer fire brick wall, a baffle within and concentric with the outer wall, and top tiles. Immediately below the tiles, slots are formed through the baffle. Flame and combustion products pass through the slots and then downwardly through a narrow passageway formed between the charge-holding crucible and the inner wall of the baffle. Thus, radiative heat from the baffle and convective heat from the flame and combustion products in the constricted passageway reach the crucible. Ultimately, the exhaust gases pass through an exhaust flue after recuperation of heat through a wall of the air plenum.

The crucible is supported principally by a base block on which it stands, but it has a flared top tip which bears downwardly upon castable fiber insulating material compressing it against the top member of the combustion chamber to maintain the integrity of the seal between the crucible and the combustion chamber.

Several of the elements of the combustion and heat transfer system serve also as structural elements of the furnace providing necessary support when the furnace is in the normal upright position or titled to pour off melt. For a better understanding of the present invention, the following detailed description of a preferred embodiment thereof should be read with reference to the appended drawings in which:

FIG. 1 is a front elevation in section of a gas-fired crucible furnace in accordance with the present invention, FIG. 2 is an enlarged inset view of the seal between the crucible and combustion chamber of the furnace, and FIG. 3 is a perspective view of a completely assembled operative embodiment of a gas-fired crucible furnace.

DESCRIPTION OF THE PREFERRED EMBODIMENT

Figure 1:
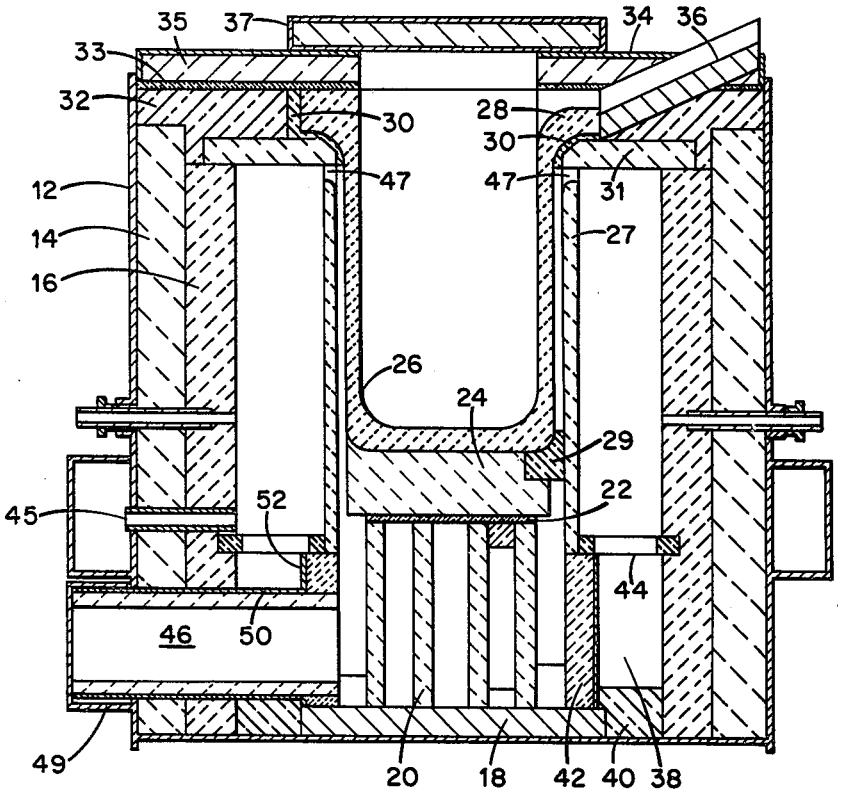

The furnace indicated in FIG. 1 is generally cylindrical in configuration and includes a steel enclosure 12 retaining a cylindrical wall of fire brick 14 which in turn surrounds a cylindrical wall of high-temperature fire brick 16. Centrally at the bottom of the enclosure a base 18 of refractory ram material is mounted and it in turn supports a pedestal 20. The pedestal 20 may conveniently be in the form of two concentric cylinders on which a pad of fiber insulation 22 is fixed. Upon the plate 22 a crucible base block 24 is mounted. A crucible for containing a charge of material to be melted derives its principal support from the base block 24. Three spaced base supports are keyed into the base block 24 and extend upwardly a short distance between the crucible 26 and a baffle 27 which surrounds the crucible. These three block supports lie in an arc located properly relative to a pouring trough to permit the baffle 27 to support the crucible 26 and the base block 24 when the furnace is tilted as pointed out in greater detail below. One of the support blocks 29 is visible in FIG. 1 at the point at which it is keyed into the base block 24 and it may be seen to extend upwardly a short distance as noted.

The baffle 27 is in the form of a solid sleeve and is prefereably made of material such as silicon carbide. It is spaced slightly from the outer wall of the crucible and a restricted annular passageway is thus formed between the two elements. At the top of the baffle, a series of tiles 31 are cemented to the baffle and to the top of the sleeve 16. The upper portion of the crucible is flared to form a lip 28 extending over the upper surface of the tiles 31. A quantity of castable fiber insulation material 30 is disposed between the elements and the weight of the crucible compresses the material to form and maintain a tight seal between the combustion chamber and the crucible. A further thicker layer of castable insulation material 32 insulates the top of the furnace. A lid 34 is bolted to the furnace and it also exerts downward pressure upon the crucible to retain it in position upon its base block 24. Within the lid is insulating fire brick material 35 which extends across the castable insulation material 32 and the lip 28 of the crucible. To maximize the sealing function of the lid 34, a blanket of fiber insulation 33 is located between the firebrick 35 and the confronting surface formed by the lip 28, material 30 and material 32. A removable insulated crucible cover 37 rests upon the lid 34. A pouring trough 36 is cemented to the lip 28 and projects at an angle outwardly through the lid 34.

Air for combustion is fed to a main air plenum 38 formed at the base of the furnace. The plenum is defined by the fire brick wall, a floor of lightweight insulating material 40 and a cylindrical swirler support 42. Air exits from the plenum through slots suitably angularly formed in a swirler 44 to impart a helical motion to the air after it is preheated by heat recuperated from exhaust gases in a manner described in greater detail below.

The high-temperature fire brick wall 16 is, as previously noted, generally cylindrical and it forms the outer wall of the combustion chamber. The inner wall of the combustion chamber is formed by the baffle 27 and the top of the combustion chamber is defined by the tiles 31. The swirlers are physically keyed into the high-temperature fire brick wall 16 at their outer periphery and are supported internally by the swirler support 42.

As the air enters the combustion chamber, it encounters gas or a gar-air mixture from a manifold which is injected by a plurality of injectors disposed at right angles to the path of the incoming air. The injector 45 is visible in the drawing and it is typical of the plurality utilized. Adjacent the top of the baffle 27, a plurality of slots are formed in spaced relationship about the periphery of the baffle. Typical slots 47 are visible in the drawing. The base of the baffle is supported by the swirler support 42, and an exhaust flue 46 penetrates the swirler support at one point. When air is introduced into the main air plenum, it is preheated by reason of the internal wall of the plenum being formed by the swirler support 42. As combustion takes place in the combustion chamber, flame and combustion products heat the baffle and pass through the slots 47 into the constricted annular passageway between the baffle 27 and the crucible 26. From the restricted passageway, the combustion products pass into the region internal of the swirler support 42 and finally exit through the exhaust tube 46. As the combustion products pass from the constricted passageway, they heat the swirler support 42 which, as a wall of the air plenum, heats incoming air.

The baffle, because it forms the inner wall of the combustion chamber, is heated to an extremely high temperature and radiates heat to the crucible 26. In addition to the radiant heat thus reaching the crucible, convective heat is also applied. The convective heat is derived from the passage of the flame and combustion products through the constricted annular passageway between the crucible 26 and the baffle 27. In a typical high-temperature operation, such as brass-melting, temperatures of the order of 2750° F. are easily attained.

It will be noted that several components of the burner and heat transfer system serve also as furnace support members. The importance of this dual function may be appreciated when it is considered that the furnace is designed to be tilted to pour off a melt through the trough 36. By way of example, the swirler support 42 and the baffle 27 constitute an important upright support. The keying of the swirler into the high-temperature fire brick wall 16 and its internal mounting upon the swirler support also contribute to the structural integrity of the furnace. Also, of course, the cylindrical pedestal members 20 are important to the rigidity of the total structure of the furnace in that they are retained at their lower ends by the refractory ram material 18, as well as being subjected to downward pressure via the crucible and its base support block 24. The block supports 29 are spaced about a minor portion of the periphery of and are wedged between the crucible and the baffle for a short distance. The arc in which they are disposed is preferably centered beneath the structure which includes the pouring trough 36.

The exhaust flue 46 is sealed through the wall made up of the fire brick sleeves 14 and 16 with a packing gland 49 which permits the exhaust tube to expand freely. The exhaust flue 46 is also enclosed in an alloy sleeve 50 to seal the exhaust tube from the air plenum and thereby to prevent entry of exhaust tube gases into the air plenum. Still another alloy ring 52 encloses the swirler support 42 to prevent air leaks. This alloy ring is welded to the alloy sleeve which surrounds the exhaust tube to prevent mixing of incoming air with exhaust products.

The swirlers 44 in addition to their function of imparting helical motion to the combustion air also serve to center the baffle 27 upon the swirler support 42. Again, during tilting of the furnace, the support function becomes important as the swirlers lying beneath the pouring trough support the baffle which in turn supports the swirlers lying at points opposite those beneath the pouring trough.

Figure 2:
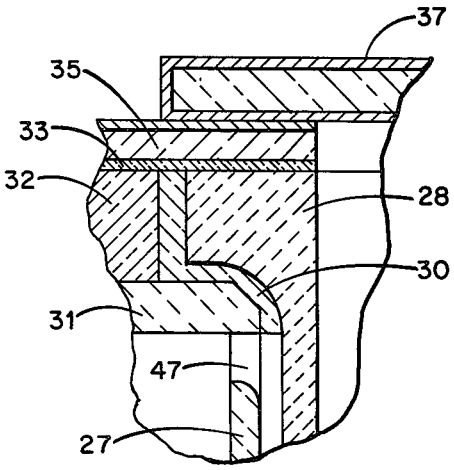

In a typical furnace installation, the crucible 26 may be approximately 32" in height with an outer diameter of 19". The inside diameter of the baffle 27 may conveniently be 20–20 ½", leaving the constricted annular passageway to be 1" to 1½". The seal 30 shown in enlarged detail in FIG. 2 between the lip 28 of the crucible and the tiles 31 may be composed of castable Fiberfrax. By suitable choice of dimension, the lip 28 is caused to press upon the Fiberfrax and mold it into a tight seal. Because much of the seal lies in an area of relatively low temperature, a substantially gas tight seal is maintained.

Figure 3:
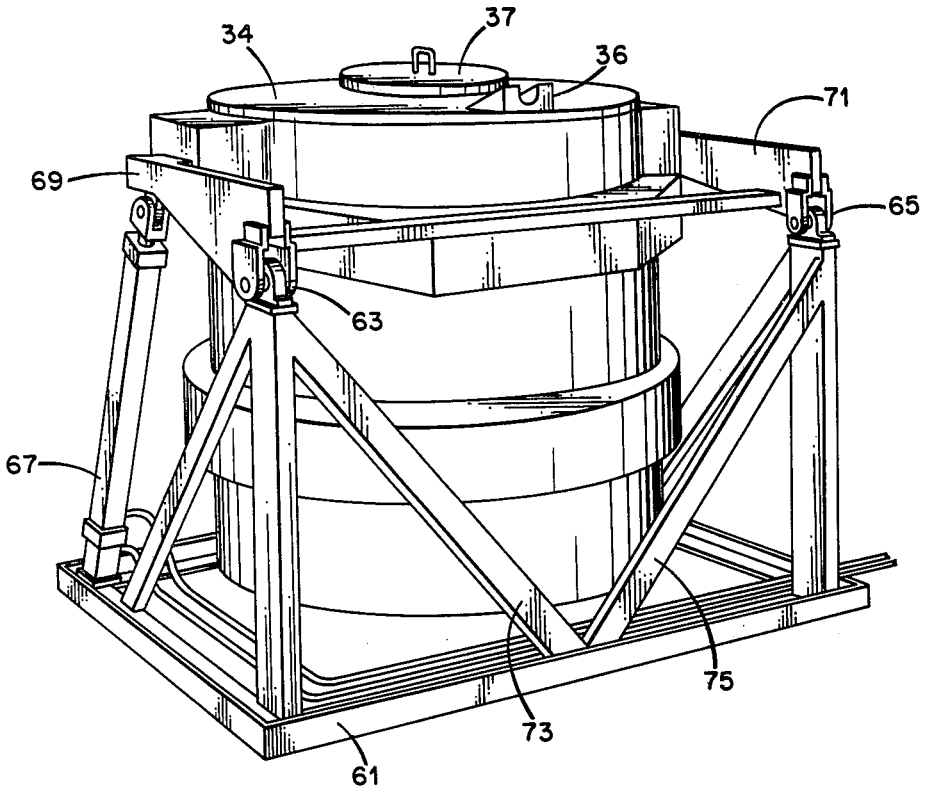

In the perspective view of FIG. 3, the furnace externals are visible. A heavy frame 61 of welded steel members supports the furnace in its upright position as shown. The furnace may be tilted about pivots 63 and 65 when it is desired to pour off a melt through the trough 36. The top cap 37 is removable to give access to the crucible. Periodic replacement of the crucible is possible by unbolting the lid 34. Upon replacement, a new seal may be formed and the lip 28 of the crucible will again compress and conform the castable material of the seal 30 to fill the gap between the lip 28 and the tiles 31. The combustion system is not disturbed in any way during such replacement.

To tilt the furnace, hydraulic lifts are provided. The lift 67 extending from the base of the frame 61 to a support arm 69 is matched by a similar lift (not visible) which extends from the frame 61 to a support arm 71. The front frame braces 73 and 75 are in the shape of a Vee to permit the furnace to pivot without interference and the melt can thus be poured into a stationary receiving crucible rather than into the conventionally used suspended crucible which moves with the tilting apparatus.

What is claimed is:

1. A gas-fired crucible furnace for high-temperature melting of material comprising:

a vessel for holding a charge of said material and having a mouth for admitting and discharging the charge of material;

a baffle surrounding said vessel spaced relatively close thereto and forming a restricted passageway therebetween, said baffle having one or more openings formed therethrough surrounding said vessel adjacent said mouth;

an enclosing wall surrounding said baffle and spaced relatively far therefrom;

a top member sealed to the outer surface of said vessel adjacent to said mouth and to said wall, said baffle, enclosing wall, and top member together defining a combustion chamber;

a swirler disposed between said baffle and said enclosing wall adjacent a portion of said baffle remote from said one or more openings therethrough, said swirler adapted to introduce combustion air into said combustion chamber in a helical path;

a cylindrical swirler support for supporting said swirler and said baffle and defining with said enclosing wall a combustion air plenum on the side of said swirler opposite said combustion chamber;

an exhaust flue communicating with said restricted passageway;

a cylindrical member supporting said vessel concentric with said swirler support and defining therewith an annular region between and in communication with said restricted passageway and said exhaust flue, said annular region in heat exchange relationship with said swirler support and said air plenum for preheating combustion air in said plenum; and means for introducing gas for combustion into said combustion chamber whereby said vessel is radiatively heated from said baffle and convectively heated from the passage of combustion products through said restricted passageway to said exhaust flue.

2. A gas-fired crucible furnace as defined in claim 1 further comprising:

a flared lip on said vessel surrounding said mouth and projecting outwardly therefrom for supporting said vessel upon said top member; and a quantity of castable insulating material disposed between said lip and said top member, said insulating material being moldable under the influence of the weight of said vessel to form a substantially gas-tight seal between said vessel and said combustion chamber.

3. A gas-fired crucible furnace as defined in claim 1 and further including plurality of fuel injectors disposed in said furnace to inject fuel into said combustion chamber at right angles to the path of air entering said combustion chamber.

4. A gas-fired crucible furnace as defined in claim 1 further including:

a frame;

means for pivotally supporting said furnace in said frame;

a pouring trough disposed at the top of said furnace and communicating with said vessel;

means for tilting said furnace about said pivotal supporting means to dispense material in said vessel through said pouring trough;

a base block disposed beneath said vessel; and a plurality of spaced block supports keyed into said base block and extending upwardly between said vessel and said baffle;

said pouring trough being disposed above and in a plane passing centrally through the arc subtended by said plurality of support blocks so that said support blocks support said vessel and said base block when said furnace is tilted.

5. A crucible furnace for high temperature melting of material comprising:

a vessel for holding a charge of said material and having a mouth for admitting and discharging the charge of material;

a baffle surrounding said vessel spaced relatively close thereto and forming a restricted passageway therebetween, said baffle having one or more openings formed therethrough surrounding said vessel adjacent said mouth;

an enclosing wall surrounding said baffle spaced relatively far therefrom;

a member sealed to the outer surface of said vessel adjacent to said mouth and to said wall, said baffle, enclosing wall, and member together defining a combustion chamber;

an exhaust flue;

air inlet means extending across the space between said baffle and said enclosing wall, adjacent a portion of said baffle remote from said one or more openings, for introducing combustion air into said combustion chamber;

means for supporting said air inlet means and said baffle and defining with said enclosing wall a combustion air plenum on the side of said air inlet means opposite said combustion chamber;

pedestal means supporting said vessel and defining with said supporting means an annular region therebetween in communication with said restricted passageway and said exhaust flue, said annular region in heat exchange relationship with said supporting means for preheating combustion air in said plenum; and means for introducing gas for combustion into said combustion chamber, whereby upon combustion of said gas in said combustion chamber said vessel is radiatively heated from said baffle and convectively heated from the passage of combustion products through said restricted passageway to said exhaust flue.

* * * * *